US007388545B2

(12) United States Patent
Wu et al.

(10) Patent No.: US 7,388,545 B2
(45) Date of Patent: Jun. 17, 2008

(54) SHIELDING DEVICE

(75) Inventors: Kang Wu, Tao Yuan Shien (TW); Chang-Cheng Hsieh, Tao Yuan (TW)

(73) Assignee: Quanta Computer Inc., Taoyuan Shien (TW)

( * ) Notice: Subject to any disclaimer, the term of this patent is extended or adjusted under 35 U.S.C. 154(b) by 221 days.

(21) Appl. No.: 11/396,609

(22) Filed: Apr. 4, 2006

(65) Prior Publication Data

US 2007/0085753 A1 Apr. 19, 2007

(30) Foreign Application Priority Data

Oct. 17, 2005 (TW) ..... 94217923 U

(51) Int. Cl.
*H01Q 1/24* (2006.01)
*H01Q 1/52* (2006.01)
*H01Q 1/48* (2006.01)

(52) U.S. Cl. ..... 343/702; 343/841; 343/846

(58) Field of Classification Search ..... 343/702, 343/841, 846
See application file for complete search history.

(56) References Cited

U.S. PATENT DOCUMENTS 6,724,348 B2 * 4/2004 Fang ..... 343/702
6,937,205 B2 * 8/2005 Chou et al. ..... 343/841

* cited by examiner

*Primary Examiner*—Shih-Chao Chen
(74) *Attorney, Agent, or Firm*—Rabin & Berdo, PC

(57) ABSTRACT

A shielding device for preventing an antenna signal from interference is disclosed. The shielding device includes a grounding component and a shielding plate. The shielding plate is made of a conductive material. The shielding plate has a first portion and a second portion. The first portion is grounded through the grounding component. The second portion is placed between an antenna and a display controller, so that the shielding plate can prevent the antenna from being interfered by the frequency component of the display controller.

10 Claims, 4 Drawing Sheets

SHIELDING DEVICE

RELATED APPLICATIONS

The present application is based on, and claims priority from, Taiwan Application Serial Number 94217923, filed Oct. 17, 2005, the disclosure of which is hereby incorporated by reference herein in its entirety.

BACKGROUND OF THE INVENTION

1. Field of Invention

The invention relates to a shielding device and, in particular, to a shielding device that prevents the antenna signal of a notebook computer from interference.

2. Related Art

Notebook computers have limited volumes. However, there are more and more devices to be integrated into a single notebook computer. The work frequency is also getting higher. Therefore, it is necessary to provide good shielding to prevent interference among devices. Modem notebook computers are already integrated with antennas for wireless communication functions. The antenna is usually integrated in the panel bracket of the display panel. The antenna transmits signals via electromagnetic (EM) waves. However, the panel itself has a liquid crystal display (LCD) driver that generates a video clock with the frequency about 65 MHz. Some high frequency components of the video clock overlap with the frequencies of the antenna operating in the 802.11 b/g band, thus interfering with the antenna signals. Therefore, how to design a shielding device to prevent the antenna of a notebook computer from interference with the video signals is very important.

SUMMARY OF THE INVENTION

An objective of the invention is to provide a shielding device to prevent the antenna signals of a notebook computer from interference.

Another objective of the invention is to provide a notebook computer that can prevent the antenna signals from interference.

Yet another objective of the invention is to provide a shielding device that can prevent the high frequency components of the LCD driver from interfering with other devices.

In accord with the above-mentioned objectives, the invention provides a shielding device to prevent the antenna signals of a notebook computer from interference. According to a preferred embodiment of the invention, the shielding device includes a grounding component and a shielding plate. The shielding plate is made of conductive material. The shielding plate has a first portion and a second portion. The first portion is electrically connected to a grounding device via the grounding component. The second portion is disposed between an antenna and a display controller. The shielding plate prevents the frequency components of the display controller from interfering with the antenna. The antenna is located in the panel bracket of the display panel. The display controller is a LCD driver. The grounding component is a metal foil. The metal foil attaches the first portion of the shielding plate to the grounding device. The metal foil and the grounding device are connected electrically.

The invention provides a notebook computer that can prevent the antenna signals from interference. According to a preferred embodiment of the invention, the notebook computer includes a host part, a panel part, and a shielding device.

The panel part is connected to the host part. The panel part has a grounding device. The panel bracket of the panel part contains an antenna. The shielding device includes a grounding component and a shielding plate. The shielding plate is made of a conductive material. The shielding plate has a first portion and a second portion. The first portion is electrically connected to the grounding device via the grounding component. The second portion is disposed between the antenna and a display controller. The shielding plate prevents the frequency components of the display controller from interfering with the antenna frequencies. The display controller is a LCD driver. The grounding component is a metal foil. The metal foil and the grounding device are connected electrically.

The invention has at least the following advantages, wherein each embodiment has one or many of the advantages. The disclosed shielding device can prevent the antenna signals of a notebook computer from interference. The disclosed shielding device can prevent the high frequency components of a display driver from interference. The invention provides a notebook computer that can prevent its antenna signals from interference.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

Figure 1:
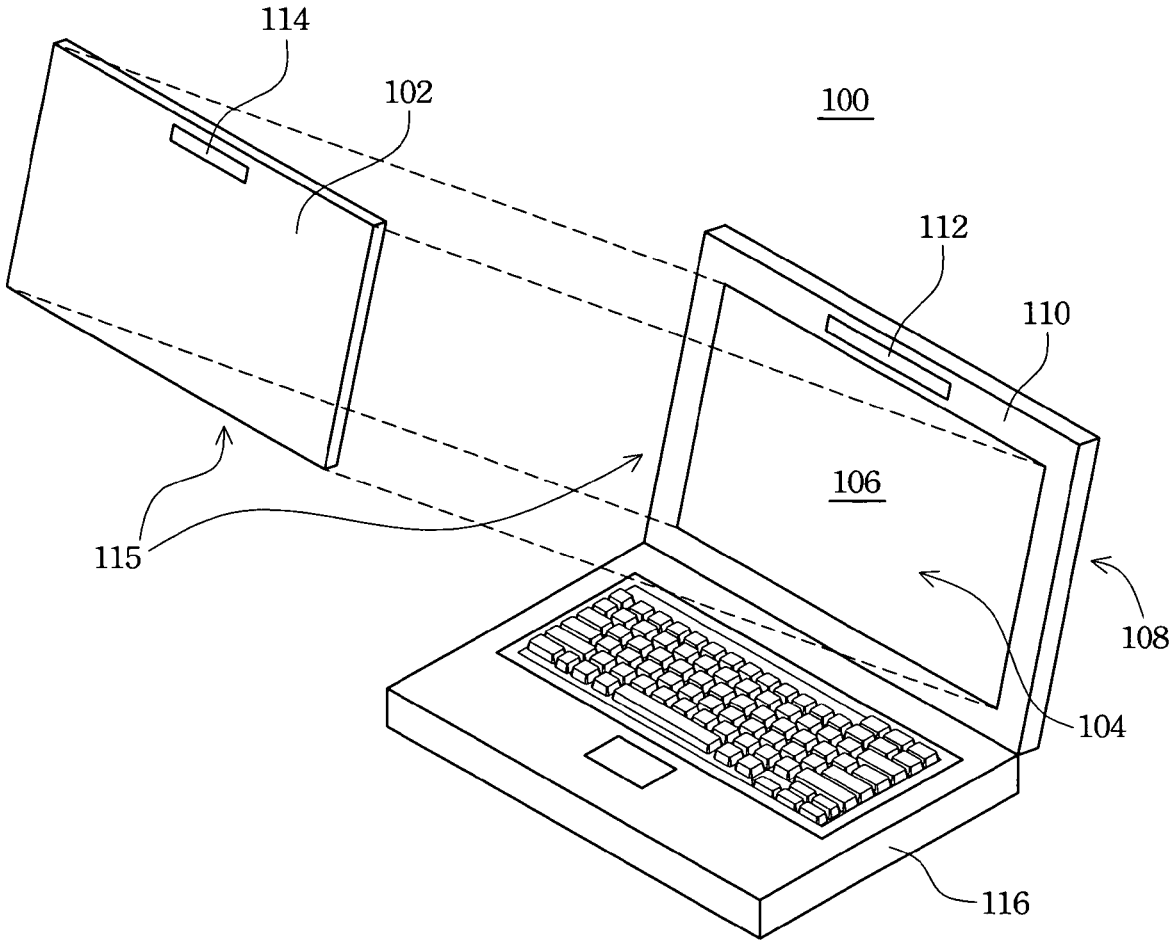
FIG. 1 is a schematic view of a notebook computer.

FIG. 1 is a schematic view of a notebook computer 100. The notebook computer 100 includes a panel part 115 and a host part 116. The panel part 115 is connected to the host part 116. For the convenience of explanation, the LCD panel 102 and the panel back shielding 104 of the notebook computer 100 are depicted separately. The LCD panel 102 is to be connected to the inner side 106 of the panel back shielding 104. The outer side 108 of the panel back shielding 104 is the top cover of the notebook computer 100.

The antenna 112 of the notebook computer is located in the panel bracket 110. The LCD panel 102 contains a display controller 114, such as a LCD driver. The LCD driver 114 generates a video clock. Since the video clock is a periodic square wave (or close to a periodic square wave), some high frequency components in the video clock may overlap with the antenna frequencies, thus interfering with the antenna signals. When the antenna 112 and the LCD driver 114 are close to each other, the interference phenomena become more prominent.

Figure 2:
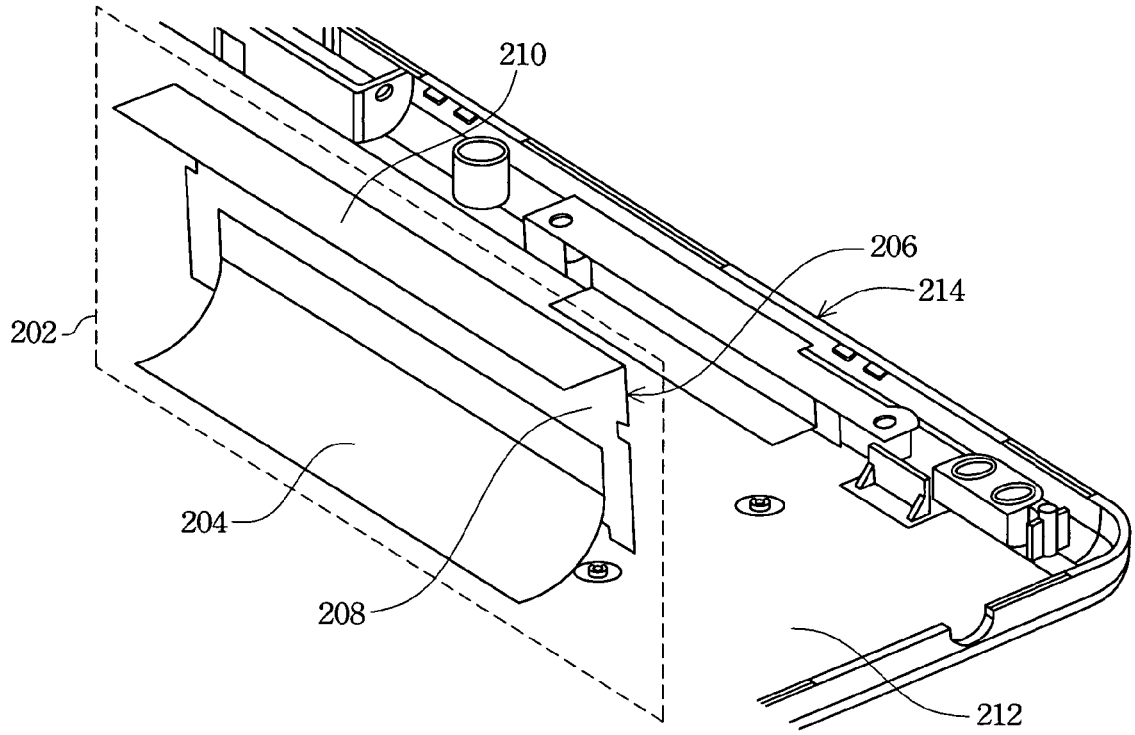
FIGS. 2 and 3 are schematic views of the shielding device according to an embodiment of the invention.
Figure 3:
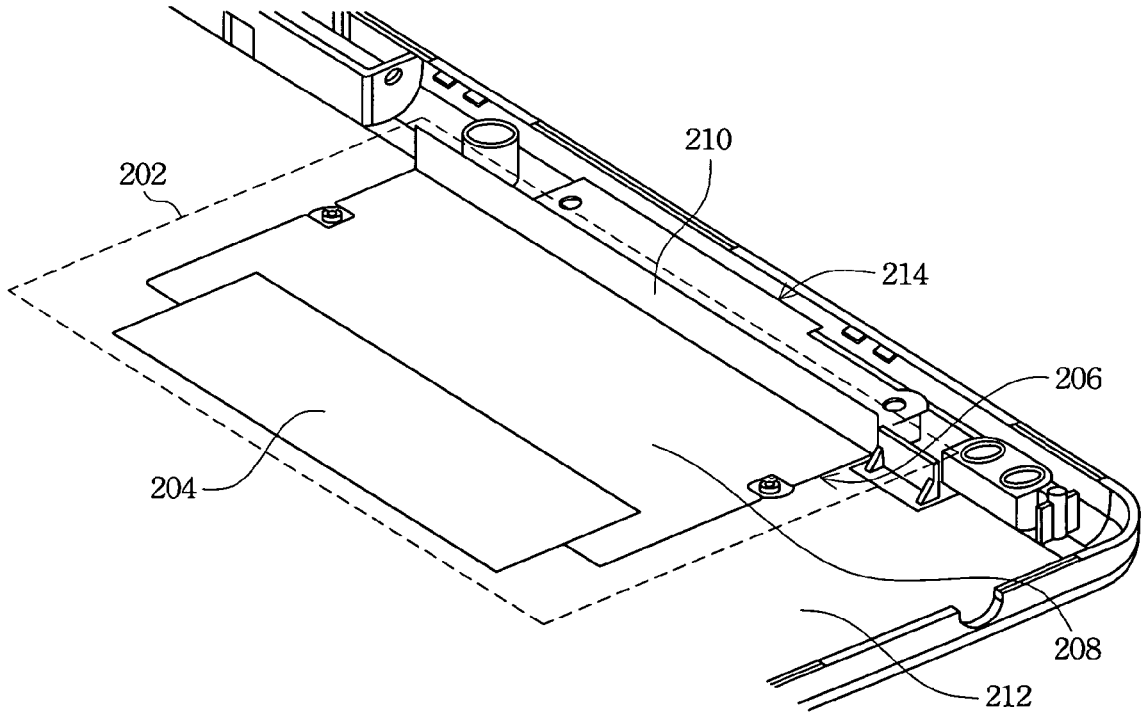

FIGS. 2 and 3 show schematic views of the shielding device in an embodiment of the invention. The shielding device 202 is used to prevent the antenna signals o the notebook computer from interference. FIG. 2 depicts a schematic view of the shielding device 202 not yet completely finished. FIG. 3 depicts a schematic view of the finished shielding device 202. The shielding device 202 includes a grounding component 204 and a shielding plate 206. The shielding plate 206 is made of a conductive material, such as the stainless steel. The shielding plate 206 has a first portion 208 and a second portion 210. The first portion 208 is electrically connected to a grounding device 212 of the panel part via the grounding component 204 (such as the panel back shielding 104 shown in FIG. 1). The second portion 210 is disposed between the antenna 214 and the display controller (whose relative position is shown by the LCD driver 114 in FIG. 1). The shielding device 202 prevents high frequency components of the display controller from interfering with the antenna 214.

The grounding component 204 may be a metal foil, such as the aluminum foil. The metal foil attaches the first portion 208 of the shielding plate 206 to the grounding device 212. The metal foil and the grounding device 212 are electrically connected.

The grounding component 204 may also be a conductive tape, such as the aluminum tape. The conductive tape attaches the first portion 208 of the shielding plate 206 to the grounding device 212. The conductive tape and the grounding device 212 are electrically connected.

With simultaneous reference to FIG. 1, the panel back shielding 104 is connected via a hinge to the notebook computer 100 and electrically connected to the base shielding of the host part 116. Therefore, the grounding reference levels of the panel part 115 and the host part 116 of the notebook computer 100 are the same.

Figure 4:
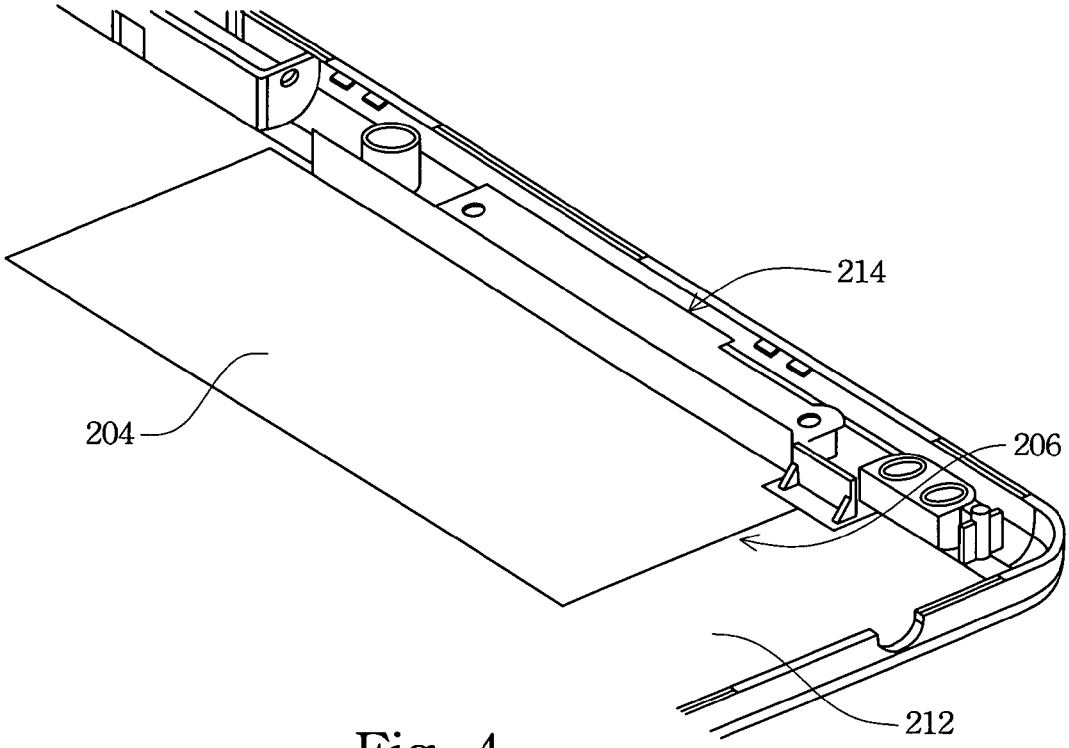
FIG. 4 is a schematic view of another embodiment of the invention.

FIG. 4 is a schematic view of another embodiment of the invention. The structure of the shielding device in FIG. 4 is generally the same as in FIG. 3. The only difference is in that the area of the grounding component 204 is enlarged, covering the connecting edge of the first portion 208 (see FIG. 3) and the grounding device 212. A larger covering area enables the shielding plate 206 to provide a better shielding effect. A better shielding effect is obtained when the area of the first portion 208 is larger than the LCD driver 114.

Figure 5:
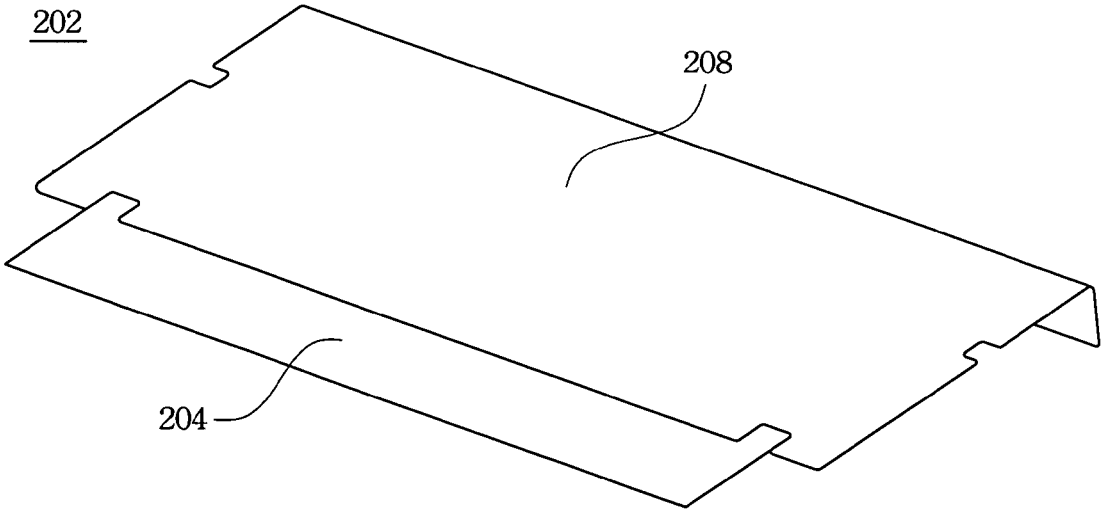
FIG. 5 shows the structure of the back of the shielding device 202 of FIG. 3.

FIG. 5 shows the structure on the back of the shielding device 202 in FIG. 3. The first portion 208 and the grounding component 204 are electrically connected for a better ground shielding effect of the shielding device 202.

Figure 6:
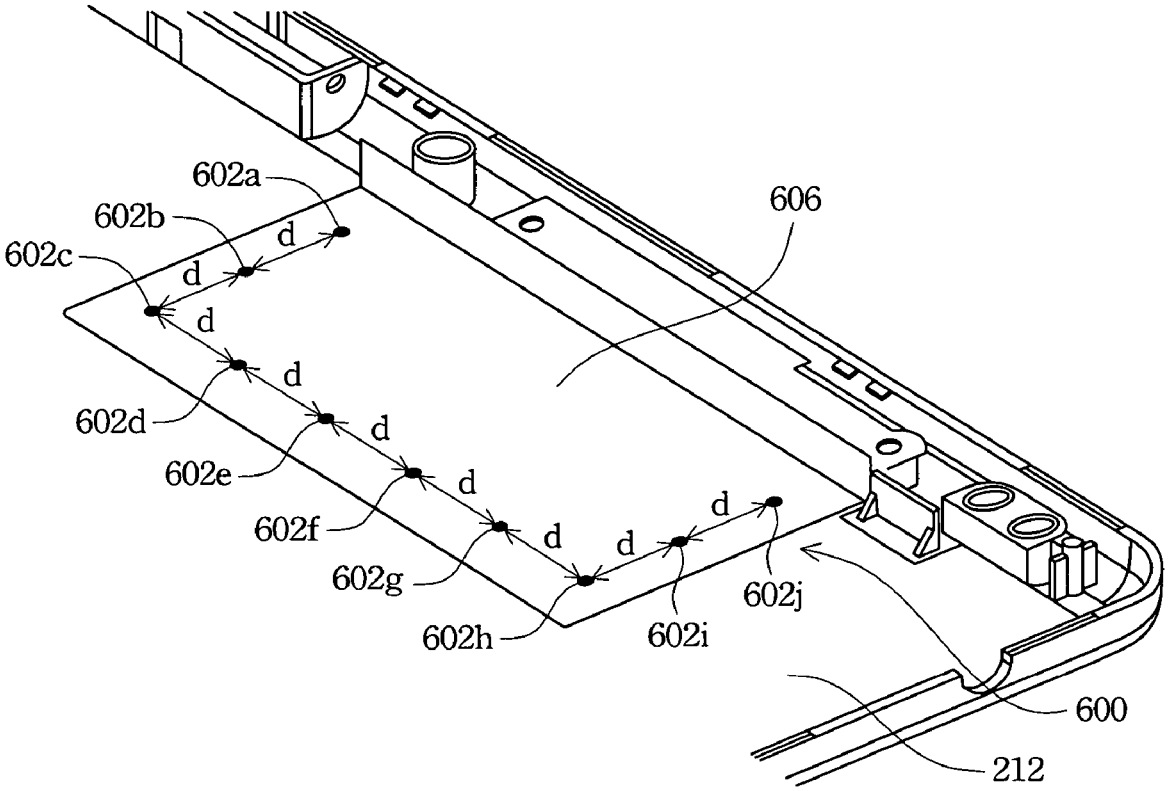
FIG. 6 is a schematic view of yet another embodiment of the invention.

FIG. 6 depicts another embodiment of the invention. The structure of the shielding device 600 in FIG. 6 is generally the same as the shielding device 202 in FIG. 3. The difference is in that the grounding component 204 of FIG. 3 is replaced by several grounding points 602*a*, 602*b*, . . . , 602*j*. The grounding points 602*a*, 602*b*, . . . , 602*j* enable the electrical connection between the first portion 606 of the shielding device 600 and the grounding device 212. The span d between the grounding points 602*a*, 602*b*, . . . , 602*j* is preferably smaller than the threshold of the shielding effectiveness. The shielding effectiveness is defined as follows:

$$SE=R+A+B(\text{in } dB)$$

where SE is the shielding effectiveness, R is the reflection loss, A is the absorption loss, and B is the conditional correction factor. The threshold of the shielding effectiveness is computed as follows:

$$\text{The threshold of the shielding effectiveness}=\lambda/20,$$

where λ is the wavelength of the EM wave to be shielded. The span d between the grounding points 602*a*, 602*b*, . . . , 602*j* is preferably smaller than 0.625 cm, if the antenna 214 operates in the frequency band of 802.11 b/g where the frequency and the wavelength are about 2.4 GHz and 12.5 cm respectively.

The invention has at least the following advantages, wherein each embodiment has one or many of the advantages. The disclosed shielding device can prevent the antenna signals of a notebook computer from interference. The disclosed shielding device can prevent the high frequency components of a display driver from interference. The invention provides a notebook computer that can prevent its antenna signals from interference.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shielding device for preventing antenna signals of a notebook computer from interference, comprising:

a grounding component; and a shielding plate, which is made of a conductive material and has a first portion and a second portion, wherein the first portion is electrically connected to a grounding device via the grounding component and the second portion is disposed between an antenna and a display controller, thereby preventing some frequency components of the display controller from interfering with the antenna, wherein the grounding component comprises a plurality of grounding points that connect the first portion of the shielding plate with the grounding device.

2. The shielding device of claim 1, wherein the antenna is disposed in a panel bracket of the notebook computer.

3. The shielding device of claim 1, wherein the display controller is a liquid crystal display (LCD) driver.

4. The shielding device of claim 1, wherein the grounding device is a panel back shielding.

5. The shielding device of claim 1, wherein a span d between the grounding points is preferably smaller than the threshold of the shielding effectiveness computed as:

$$\text{the threshold of the shielding effectiveness}=\lambda/20,$$

where λ is the wavelength of the EM wave to be shielded.

6. A notebook computer for preventing antenna signals from interference, comprising:

a host part;

a panel part, which is connected to the host part and has a grounding device and a panel bracket containing an antenna; and a shielding device, including:

a grounding component;

a shielding plate, which is made of a conductive material and has a first portion and a second portion;

wherein the first portion is electrically connected to the grounding device via the grounding component and the second portion is disposed between the antenna and a display controller, thereby preventing some frequency components of the display controller from interfering with the antenna, wherein the grounding component comprises a plurality of grounding points that connect the first portion of the shielding plate with the grounding device.

7. The shielding device of claim 6, wherein the display controller is a liquid crystal display (LCD) driver.

8. The shielding device of claim 6, wherein the grounding device is a panel back shielding.

9. The shielding device of claim 6, wherein a span d between the grounding points is preferably smaller than the threshold of the shielding effectiveness computed as:

$$\text{the threshold of the shielding effectiveness} = \lambda/20,$$

where $\lambda$ is the wavelength of the EM wave to be shielded.

10. The shielding device of claim 6, wherein the area of the first portion is larger than the area of the display controller.

* * * * *